United States Patent [19]

Halem et al.

[11] Patent Number: 5,004,158

[45] Date of Patent: Apr. 2, 1991

[54] FLUID DISPENSING AND MIXING DEVICE

[76] Inventors: Stephen Halem, 47 Sargent St.; Philip R. Lichtman, 3 Valley Spring Rd., both of Newton, Mass. 02158

[21] Appl. No.: 396,520

[22] Filed: Aug. 21, 1989

[51] Int. Cl.[5] ..... B05B 7/32

[52] U.S. Cl. ..... 239/310; 137/564.5; 222/214; 222/385; 239/313; 239/317; 239/322; 239/323; 239/443; 239/588

[58] Field of Search ..... 239/310, 313, 317, 322, 239/323, 443, 588; 137/564.5; 222/214, 385

[56] References Cited

U.S. PATENT DOCUMENTS

| | | | |
|---|---|---|---|
| 1,574,183 | 2/1926 | Bodfish | 239/313 |
| 2,588,255 | 3/1952 | Larsh | 239/310 |
| 2,592,885 | 4/1952 | Fox et al. | 239/313 |
| 2,891,732 | 6/1959 | Orter et al. | 239/322 |
| 3,104,823 | 9/1963 | Hayes | 239/317 |
| 3,134,545 | 5/1964 | Armond | 239/443 |
| 3,187,769 | 6/1965 | McDowell et al. | 137/564.5 |
| 3,292,867 | 12/1966 | Hunter | 239/317 |
| 3,367,353 | 2/1968 | Hunter | 239/310 |
| 3,446,438 | 5/1969 | Watson | 239/317 |
| 4,047,541 | 9/1977 | Mercier et al. | 239/313 |
| 4,171,070 | 10/1979 | Colgate et al. | 239/313 |
| 4,203,551 | 5/1980 | Levine | 239/588 |

*Primary Examiner*—Andres Kashnikow
*Assistant Examiner*—Michael J. Forman
*Attorney, Agent, or Firm*—Schiller, Pandiscio and Kusmer

[57] ABSTRACT

A device intended primarily for use in a shower stall that is adapted to dispense a predetermined total amount of a selected additive into a water stream, with the rate of mixing of the additive and water being controlled as a function of the water pressure. A positive displacement pump is used to dispense the additive from a storage chamber, and the additive is dispensed via a controllable applicator device.

26 Claims, 2 Drawing Sheets

FLUID DISPENSING AND MIXING DEVICE

This invention relates to fluid dispensing and mixing devices and more particularly to a device, adapted to be attached to a bathroom shower system, that is designed to dispense a predetermined amount of a selected chemical under the influence of pressurized water derived from the shower system.

PRIOR ART

A variety of devices have been devised for mixing one fluid with another. Among such mixing devices are devices for mixing a selected chemical with water being discharged from a shower head or a hand operated spray nozzle. Exemplifying such prior art are the following U.S. Pat. Nos.: 4358056, 3461870, 2588255, 2886214, 4027822, 4568027, 2848728, 3581998, 4281796, 3632046, 4193520, 3734410, 4295612.

Prior devices for mixing a liquid with bath water have generally been designed so as to provide a continual inflow and mixing of a selected liquid additive, e.g., shampoo, and water from a shower head or hand spray nozzle so long as the shower head or hand spray nozzle is being operated. While such devices have utility, they are not suitable for use in cases where it is desired to dispense a predetermined total dosage, a predetermined rate of dosage per unit time, or both, of the selected liquid additive.

Devices capable of dispensing a predetermined quantity of an additive in a bath installation are desirable for the application of cleansing agents, topical medications, and selected pharmaceuticals to selected body regions of individuals, e.g., applying a douching or medicinal agent as a lavage for the vagina and uterus, or pharmaceuticals to the oral cavity.

STATEMENT OF OBJECTS

Accordingly, the primary object of this invention is to provide a device which is designed to dispense a predetermined amount of a selected additive, e.g., a pharmaceutical or other chemical, and to mix that additive with a water stream, with the dosage of the additive being limited and the rate of dispensing of the selected chemical or other pharmaceutical being set as a function of the flow of water.

A further object of the invention is to provide a system of the character described for applying a selected additive, e.g., a pharmaceutical or other chemical agent, to a selected region of a human body in a manner whereby (a) the total amount of the additive that is dispensed is limited and (b) the ratio of additive to water in the additive/water mixture is substantially constant.

A further object of the invention is to provide a new and improved device for mixing a predetermined amount of a selected chemical with a stream of a selected liquid.

Still another object of the invention is t provide a device intended primarily for use in a shower stall that is adapted to provide a metered amount of a selected additive to a water stream, with the rate of mixing of the additive and water being controlled as a function of the rate of flow of the water stream.

A more specific object of the invention is to provide a device that is adapted to dispense a predetermined total amount of a selected additive under the influence of a hydraulic force.

A further object is to provide a device that is adapted to dispense an additive into a water stream with the dispensing terminating automatically when a predetermined amount of additive has been dispensed.

Another specific object it to provide a device of the character described in which the selected additive is dispensed via a controllable applicator device, and the rate at which the additive is dispensed is a function of the rate of flow of water to the applicator device.

SUMMARY OF THE INVENTION

These and other objects are achieved by a device which, in the preferred embodiment of the invention, is adapted for use in a shower or bath unit or system. Turning on the shower or bath unit or system serves to arm the device, so that it may be used on demand by the operator. Thereafter, until the shower or bath unit is turned off, the device is capable of delivering a stream or spray of water into which is metered a predetermined amount of a selected additive drawn from a reservoir located in or adjacent to the shower or spray device. The rate at which the additive is drawn from the reservoir and injected into the water stream or spray is determined by the mixing device. Delivery of additive continues until all of the quantity of additive has been dispensed, unless the operator turns off the shower system before all of the additive has been dispensed. Under normal operating conditions, delivery of the predetermined quantity of additive takes a predetermined period of time determined by the calibration of the device, after which the flow of additive ceases and the flow of water continues until the operator turns off the shower or bath unit or system. Once the system has been turned off, the device is automatically recharged with another predetermined amount of additive.

In a general sense, a device constructed according to the present invention comprises the following: (1) a supply tee which is connected between the shower pipe and a showerhead or bath water discharge device; (2) a reservoir which holds a supply of additive; (3) a hydraulically operated positive displacement pump located inside the reservoir (although other locations are possible); (4) a hand piece which provides a delivery stream or spray of the mixture of additive and water; and (5) means for controlling the rate and direction of flow of liquid into and out of the pump. These elements are suitably interconnected so as to achieve the objectives of this invention.

Other features and advantages of the invention are described or rendered obvious by the following detailed specification and the accompanying drawings.

THE DRAWINGS

Like parts are identified by like numerals in the several figures constituting the drawings.

DETAILED DESCRIPTION OF THE INVENTION

Figure 1:
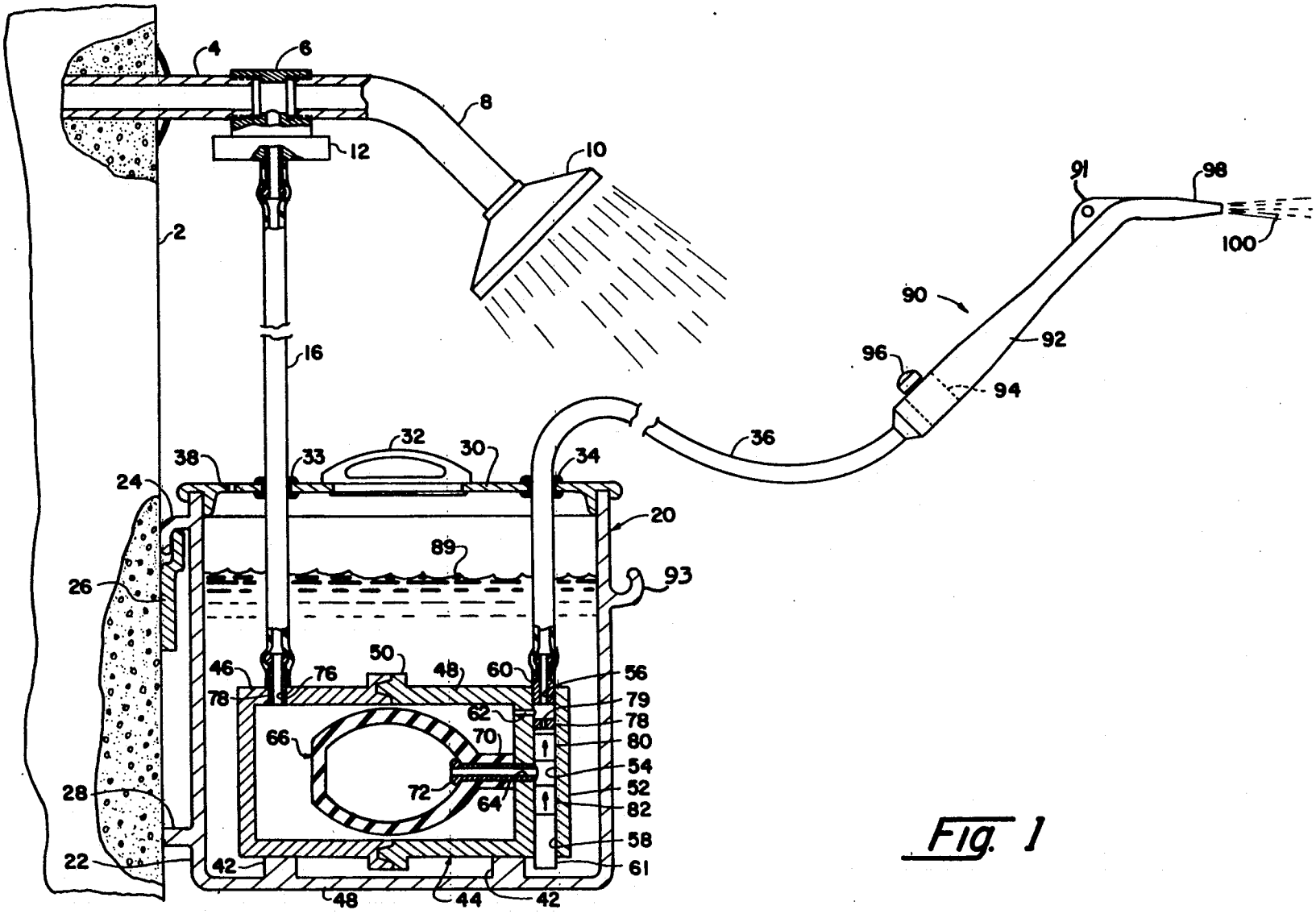
FIG. 1 is a partially schematic and sectional view in elevation of a preferred embodiment of the invention.

Referring now to FIG. 1, there is shown a portion of a shower stall or bath comprising a wall 2 from which projects a shower head water supply pipe 4. Although not shown, it is to be understood that pipe 4 is connected to a domestic water supply via a shower control or mixing valve (not shown) installed in wall 2 or elsewhere. The discharge end of pipe 4 is connected to one end or port of a tee 6. The other two ends or ports of tee 6 are connected in turn to a pipe 8 that supports a shower head 10, and also to a hose or tube 16. Preferably, the latter is a flexible hose and makes a friction seal with tee 6. Alternatively member 16 may be a metal tube and may be soldered, welded or brazed to tee 6.

The device shown in FIG. 1 also comprises a container 20 for holding a supply of a selected additive 89. Container 20 has a back wall 22 fitted with a lip or flange 24 that overhangs and is supported by an offset support member 26 that is affixed to shower stall wall 2. Container 20 may be provided with a lip 28 that bears against wall 2 and is sized to vertically align the container.

Still referring to FIG. 1, container 20 is provided with a releasable cover 30. While not absolutely necessary, the cover may be provided with a handle 32 to facilitate lifting the cover away from the container. Cover 30 is provided with two holes that are provided with sealing rings 33 and 34. These sealing rings support the hose or tube 16 and also a second hose or tube 36, so that an hermetic seal is formed between those hoses or tubes and cover 30. Additionally, the cover 30 is provided with a vent hole 38 to eliminate any vacuum being established within the container 20.

In the preferred embodiment of this invention shown in FIG. 1, the bottom wall 40 of container 20 is provided with two or more upstanding legs 42 that serve to support and secure a vessel 44. The latter may take various shapes, but in this embodiment of the invention it is preferably rectangular in longitudinal section and circular in cross-section. Vessel 44 is preferably formed in two halves 46 and 48 that have complementary flanges hermetically sealed together as shown at 50. One end wall 52 of container 44 is provided with a through bore 54 comprising an upper end or port 56 and a bottom end or port 58. Nipples 60 (and optionally 61) are mounted in ports 56 and 58 respectively. Vessel 44 also has openings or passageways 62 and 64 that intersect with bore 54. Passageway 62 has a relatively small diameter and functions as a first control orifice. Passageway 64 is a larger sized bore and serves to provide communication between the interior of bulb 66 and bore 54.

Still referring to FIG. 1, mounted within the vessel 44 is a resilient bulb 66 which preferably is made of rubber and comprises an elliptical or elongated hollow body terminating in a tubular end extension or nozzle 70. The latter is mounted on and is hermetically sealed to the end of a tube 72 that is affixed in passageway 64. The upper wall of vessel 44 is provided with a port 76 in which is mounted a nipple 78. The latter is attached to the hose or tube 16.

As seen in FIG. 1, mounted in through bore 54 is an annular orifice member 78 that provides a second control orifice 79 located between ports 56 and 58. Also mounted in through bore 54 are two one-way check valves 80 and 82. Check valve 80 is mounted so as to permit flow of liquid toward nipple 60 but not toward passageway 64 or bottom port 58, while check valve 82 is designed to permit flow of liquid through bottom port 58 to passageway 64, but not flow of liquid from passageway 64 toward port 58. More specifically, check valve 82 is arranged to permit liquid to flow into the bottom end (as viewed in FIG. 1) of bore 54, while check valve 80 is designed to allow liquid to flow out of the upper end of bore 54 via nipple 60.

It is to be understood that the control orifices 62 and 79 are much smaller in diameter than any of the other passageways or ports between tee 6 and handpiece 90.

As seen in FIG. 1, outlet tube 36 is connected to a suitable handpiece unit 90. The latter may take various forms, but preferably it comprises a tubular member 92 having an on/off control valve 94 (illustrated in phantom) that is operated by a control valve operating button or knob 96, and a spray nozzle 98 which is adapted to spray liquid in a stream 100 of predetermined cross-sectional geometry. Of course, the control valve for the hand piece unit 90 may take various forms of on-off or variable flow valves. Details of control valve 94 are not revealed for the reason that the valve does not form a critical part of the present invention and persons skilled in the art may use various types of conventional control valves as valve 94.

Operation of the device shown in FIG. 1 will now be described. In this connection it is to be appreciated that at the time the water is turned on, i.e., water is supplied to pipe 4, the device is already "charged". Charging the device means that bulb 66 is substantially full of additive, and the system is ready to dispense the dosage of additive contained in bulb 66. Assume for purposes of this description that flow of water in pipe 4 has been initiated by operation of a suitable control or mixing valve (not shown) that forms part of the shower or bath installation, and also that at the time that flow of water is initiated through pipe 4, container 20 and bulb 66 are filled with a selected liquid additive 89. At this point the system is considered to be armed. Assume also that control valve 94 is now opened by the user. The water flowing in pipe 4 is partially diverted into hose or tube 16. That diverted water stream enters the interior of vessel 44 through the nipple 78, causing pressure to be exerted on the exterior of bulb 66, whereupon the bulb will begin to compress and to eject the additive 89 that it contains. The additive ejected from bulb 66 will flow out of the system via check valve 80, nipple 60 and tube 36 to handpiece unit 90 in admixture with water flowing through vessel 44 via control orifice 62. The flow of additive will continue until the entire volume of additive in bulb 66 has been exhausted, unless, of course, the valve 94 is closed or flow of water to supply pipe 4 is terminated earlier. The rate at which the additive is exhausted from bulb 66 is determined by the water pressure in tube 6 and the orifice area of control orifice 79, and the concentration of additive in the mixture of water and additive supplied to handpiece 90 is a function of the ratio of the effective areas of control orifices 62 and 79. How long it takes to empty bulb 66 of additive is determined by the water pressure in line 16 and the effective area of control orifice 79.

Thereafter, the flow of water is terminated. When the flow of water to supply 4 is shut off, the pressure in line 16 drops back to atmospheric pressure via shower head 10. At this point the reduced pressure in vessel 44 permits bulb 66 to expand through its own resilience. This action sucks additive 89 into the bulb from container 20 through one-way check valve 82. Substantially the entire volume of bulb 66 will be filled with additive 89. The port 38 in cover 30 applies atmospheric pressure to the additive in container 20, assisting it to flow up into bore 54.

At this point, the system has been recharged, ready to dispense another dosage of additive the next time water flow commences in supply pipe 4.

Another possible description of the operation is as follows: when the operator turns the shower on, the supply line water pressure is immediately conducted to the pump which comprises the rubber bulb 66 and the check valves 80 and 82. It is preferred that the shape of the bulb be oval or elongated, since a spherical bulb may tend to resist compression. When handpiece 90 is turned on, pressurized water diverted from pipe 4 will flow into vessel 44 via tube 16 and nipple 78. Due to the abundant supply of water to the pump, the water pressure in the pump is substantially unaffected by the discharge of water from handpiece 90. Consequently, the water pressure in vessel 44 squeezes uniformly on rubber bulb 66 which is full of additive drawn from reservoir 20. This action urges a flow of additive out of the bulb and away from the pump through the metering orifice 79. The expelled additive combines with the water discharged via control orifice 62 to form the working mixture. When the flow of water is terminated in supply pipe 4, the bulb will tend to expand and in so doing will suck in additive from container 20 until the bulb is fully expanded.

Each use of the device through a complete cycle results in the delivery of a known or metered quantity of additive, fundamentally fixed by the volumetric capacity of the bulb. The ratio of additive to water is fixed by the geometry of the system. If the hand piece 90 is turned off before the device times itself out, a liquid quantity of additive proportional to the percentage of cycle time utilized is delivered. The cycle time, which may approximate one minute, is determined by the supply water pressure in water supply line 4 (which is preferably regulated), the capacity of bulb 66, and the additive metering orifice 79. These parameters may be adjusted to suit the intended purpose of the device.

The concentration of additive in the water in line 36 once the pump and other system parameters have been fixed, remains substantially constant even if the supply water pressure varies, notwithstanding that such a variation affects the cycle time or "timing out". The reason for the constancy of additive concentration is that the water flowing through vessel 44 via control orifice 62 and the bulb 66 squeeze rate are both substantially proportional to the water supply pressure, and consequently move in lock step.

It is to be appreciated that the control or mixing valve that controls the flow of water to shower head 10 is generally situated upstream of the shower head. Consequently when the shower is turned off, pressure inside the pump housing i.e., vessel 44, (which might otherwise inhibit expansion of the bulb) is relieved by back flow of water through supply tee 6 and out shower head 10. It is to be noted also that if the hand piece control valve 94 is open, the hand piece provides another avenue of escape for water otherwise entrapped in the pump housing. In some situations the shower control valving may be downstream of the supply tee, in which case an additional pressure regulator circuit might be necessary. However, such applications are uncommon.

It is appreciated that in many shower installations, i.e., shower stalls or shower units associated with bathtubs, the water pressure in the shower head supply pipe (i.e., pipe 4 in FIG. 1) may not be constant but may vary substantially depending on localities and building plumbing systems. Thus, for example, while some hotel plumbing systems include pressure regulators for maintaining water pressure in individual bath installations, many other hotels lack pressure regulators. Preferably, the invention is used in cases where the water supply is pressure regulated, since pressure fluctuations (depending on size and frequency) may prevent the invention from operating with maximum satisfaction. However, it is contemplated that in those cases where the water pressure is not regulated and undergoes frequent and substantial changes, this invention is to include a pressure regulator, represented schematically as 12 in FIG. 1, for the purpose of regulating the water pressure in line 16. The pressure regulator 12 may be attached to tee 6 as shown in phantom in FIG. 1, or interposed otherwise into line 16, or located elsewhere. Thus, for example, the pressure regulator could be made a part of container 20.

OTHER MODIFICATIONS

It is to be appreciated that the positive displacement pump of FIG. 1, comprising bulb 66 and the check valves 80 and 82, may take other forms which do not alter the fundamental operation of the device.

Figure 2:
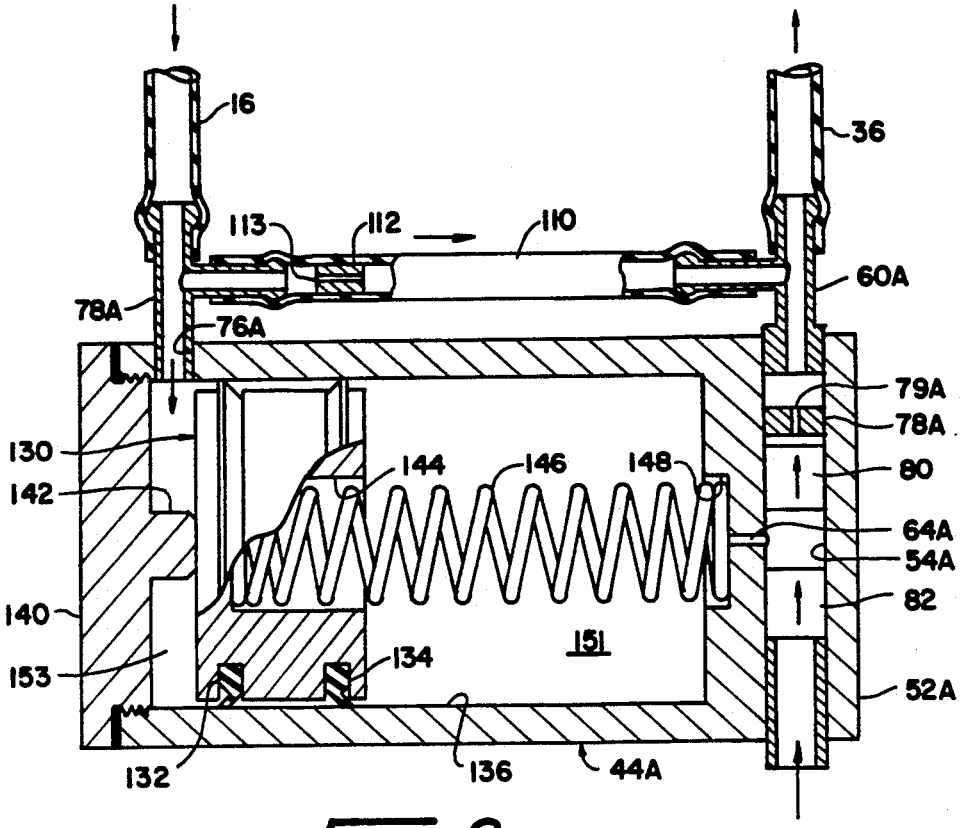
FIG. 2 is a fragmentary sectional view on an enlarged scale of an alternative embodiment of the invention.

FIG. 2 shows one alternative embodiment of the pumping mechanism. In this case the pump is a free piston displacement pump. The pumping mechanism comprises a vessel 44A. Although not shown, it is to be understood that vessel 44A is mounted in container 20 in place of vessel 44. Vessel 44A has an end wall 52A having a bore 54A. Disposed in the bore 54A are two check valves 80 and 82 that are identical to check valves 80 and 82 of FIG. 1.

Vessel 44A also has an inlet port 76A fitted with one end or port of a tee 78A. The latter has its upper port connected to line 16, while its third port is connected to a tube or hose line 110. Mounted in line 110 is a member 112 providing a metering or control orifice 113 which controls the rate of flow of water from the tube 16 through line 110. Orifice 113 is analogous to control orifice 62.

Still referring to FIG. 2, a tee member 60A is mounted in the upper end of bore 54A. The second port of tee 60A is connected to discharge tube 36. The third port of the tee member 60A is affixed to line 110. Hence, line 110 provides a shunt around vessel 44.

Mounted within bore 54A is an orifice member 78A providing a metering or control orifice 79A that controls the rate of flow of additive 89 into the tee member 60A from bore 54A. The device shown in FIG. 2 includes a passageway 64A which intersects bore 54A between check valves 80A and 82A and communicates with the interior of vessel 44A. Passageway 64A functions similarly to passageway 64, permitting in-flow of additive to vessel 44A from reservoir 20 via check valve 82, and discharge of additive to line 36 via check valve 80. Passageway 64A has a greater diameter than control orifice 79A.

Mounted within the chamber 44A is a piston 130. The latter is provided with peripheral seals 132 and 134 Which make a sliding engagement with the interior surface 136 of chamber 44A. In this connection it is to be noted that the interior of vessel 44A preferably has a cylindrical cross-section, so that its interior surface 136 is cylindrical. Similarly piston 130 is a cylindrical member, and seals 132 and 134 are circular ring seals.

Vessel 44A is provided with internal threads at one end to receive a cover or cap member 140 which functions as an end wall for the chamber. The latter has a protuberance 142 which serves as a stop for piston 130. The length of the protuberance is such as to prevent piston 130 from blocking the inlet port 76A, thereby assuring that water will flow into vessel 44A via line 16 at all positions of piston 130.

Piston 130 is provided with an interior cavity 144 which serves to receive one end of a compression spring 146. The opposite end of spring 146 is disposed in a cavity in end wall 52A in the form of a counterbore 148 centered on orifice 64A. However, bore 64A and counterbore 148 need not be coaxial.

Operation of the device in FIG. 2 is as follows. In this description, it is assumed that vessel 44A is mounted within container 20 in place of vessel 44, so that additive 89 can flow into vessel 44 via nipple 61A, check valve 82 and passageway 64A, and additive can flow out of vessel 44 via passageway 64A, check valve 80 and tube 36. Movement of the piston 100 to the "charged" position shown in FIG. 2 is opposed by the water pressure in line 16. However, spring 146 is sized to restore the piston to the charged position shown in FIG. 2 when the interior space 151 of the chamber 44A is empty of additive, and water flow in pipe 4 has been stopped so that the pressure in the space 153 on the left-hand side of the piston (as seen in FIG. 2) will be substantially atmospheric (assuming negligible hydrostatic pressure in line 16). The pressure on the opposite side of the piston will be the hydraulic pressure of the additive in bore 54A. The latter will be at atmospheric (or slightly above atmospheric if there is any significant hydrostatic head in container 20). In any event, when the space 153 is at substantially atmospheric pressure due to no flow of water in supply pipe 4, spring 146 will urge piston 130 away from end wall 52A toward stop 142, causing additive to be drawn into vessel 44A via check valve 82. In this position, the space 151 existing between the piston 130 and the end wall 52A is filled with additive.

Assuming that piston 130 is in the position shown in FIG. 2 and the volume 151 is filled with additive, when water flow is initiated in line 4, water will tend to flow into the space 153 between end wall 140 and piston 130, causing the piston to move toward end wall 52A, i.e., to the right as shown in FIG. 2. This movement of piston 130 serves to displace the additive in the volume 151, causing that chemical to be discharged via port 60A through check valve 80, orifice 79A and tee 60A, into line 36. Because the line 110 is connected to line 16, discharge of additive from the volume 151 cannot back flow to line 16, due to the pressure existing in the line 16. On the other hand, the water flowing via line 16 into line 110 serves to dilute the additive being discharged via tee 60A into line 36. The rate of discharge of additive from space 151 is a function of the differential of the water pressure in line 16 and the pressure in container 20 (the latter is substantially atmospheric). The additive contained in volume 151 will be discharged fully when piston 130 engages end wall 52A. At that point, all of the additive having been discharged, the fluid flowing out of line 36 will be pure water received from line 16 via control orifice 113. The piston 130 will remain in contact with the end wall 52A until such time as the system is shut down, i.e., flow of water into the chamber 44A via line 16 is terminated. At that point, the force of spring 146 will force the piston back to the position shown in FIG. 2, and the atmospheric pressure in the container 20 will cause the additive to flow from container 20 into space 151 via nipple 61A, check valve 82, and orifice 64A. Once piston 130 has engaged stop 142, further inflow of chemical from the container 20 is terminated, and the system is now "charged" so as to be able to expel another dosage of additive the next time water flow in line 4 is initiated.

Figure 3:
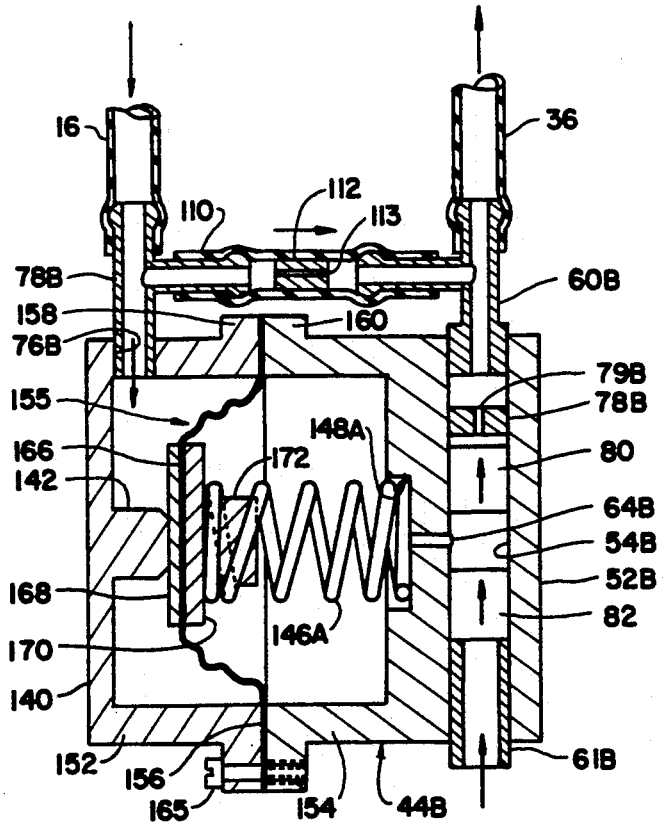
FIG. 3 is a view like FIG. 2 of a second alternative embodiment of the invention.

FIG. 3 shows another alternative embodiment of the device that comprises a diaphragm pump. In this case the vessel 44B is formed in two hollow cylindrical parts 152 and 154. These two parts are secured to one another to form an enclosed chamber. However, in this case a diaphragm 155 is provided as the displacement means for dispensing the additive. Diaphragm 155 has a peripheral flange or rim portion 156 that is captivated between peripheral flanges 158 and 160 of parts 152 and 154, with those flanges being secured together such as by screw means as shown at 165. The diaphragm also includes a center portion 166 that is attached to a diaphragm support assembly comprising a first member 168 and a second member 170. The center portion of the diaphragm is sandwiched and captivated between members 168 and 170 by suitable means, e.g., cement or fastener means (not shown). Member 170 has an axial extension 172 which serves as a captivating support for one end of a compression spring 146A. The opposite end of spring 146A is disposed in a counterbore or recess 148A in end wall 52B of vessel 44B. The latter also has an outlet port 64B that is concentric with recess 148A. However, it is to be understood that the discharge port 60B and recess 148A need not be coaxial.

Vessel part 152 has an end wall 140 provided with an extension 142 that serves as a stop for diaphragm support member 168, stopping the diaphragm so as not to block introduction of liquid via tee 78B. In this connection it is to be noted that vessel 44B also has an inlet port 76B that is fitted with a tee 78B. The latter is connected to line 16 and also to a line 110 which in turn is connected to a tee 60B that is mounted in the upper end of bore 54B. The third portion of the tee 60B is connected to line 36. An orifice member 112 with a control or metering orifice 113 is mounted in line 110 to control flow of water from line 16 to line 36 via line 110. An orifice member 78B providing a control orifice 79B is mounted in bore 54A between check valve 80 and tee 60B.

Operation of the system of FIG. 3 is essentially the same as operation of the system shown in FIG. 2. When the system is fully "loaded" or "charged", diaphragm 154 is in the position shown in FIG. 3, and the volume 180 is filled with additive introduced via the nipple 61B, while the volume 181 on the opposite side of the diaphragm 140 is filled with water introduced via line 16. Assuming that water flow is started in line 4, if now the control valve 94 is operated so as to permit unit 90 to discharge water and additive, the pressure exerted by the water flowing in line 16 will act on diaphragm 140 to force the latter to move to the right in FIG. 3. That movement of the diaphragm will expel additive from the volume 180 via the exit port 64B and check valve 80 into line 36.

The additive discharged via tee 60B will be diluted by the water in line 110, whereby the liquid in line 36 will comprise a mixture of water and the additive discharged from the volume 180 of vessel 44B.

The rate of flow of additive into line 36 depends upon the water pressure in line 16, as well as on the size of control orifice 79B. On the other hand, the total dosage of additive is determined by the volume 180, since when the extension 172 engages end wall 52A, the diaphragm can expel no further chemical into line 36. In FIG. 2, the volume 151 determines the dosage of additive that is dispensed. Thus, as is obvious from the foregoing description, the pump devices shown in FIGS. 2 and 3, when substituted for the pump shown in FIG. 1, will provide a predetermined dosage of additive, with the rate of introduction of the chemical into the water stream being controlled by the water pressure and control orifices 79–79B, and the concentration of the additive in the output mixture being determined by the ratio of orifices 79–79B to orifices 62 or 113 as the case may be.

It is to be understood that this invention is not limited to the specific embodiments shown in FIGS. 1–3. Instead it should be appreciated that the invention utilizes a hydraulically operated positive displacement pump to control introduction and dosage, i.e., metering, of a selected pharmaceutical or other chemical into a water stream, and that other pump arrangements may be used in place of the arrangements illustrated in FIGS. 1–3. Also the dual check valves 80 and 82 and control orifice 79 need not be mounted integral with vessels 44A–C, but could be mounted separately from and connected to the vessel by suitable lines. Similarly control orifice 62 could be part of a separate flow member connecting vessel 44A–C to the check valves.

Another possible modification is to replace on-off valve 94 with a timer-type control valve so that when the timer is actuated, the valve will open and remain open for a predetermined period of time sufficient to insure that all of the dosage is dispensed.

As used herein, the term "additive" shall be construed to include various liquid chemical agents commonly dispensed in admixture with water, e.g., a shampoo or other liquid soap of detergent composition, a douching agent, a bubble bath composition, a disinfectant, a deodorizer, an anti-bacterial or anti-fungal agent, a skin balm or palliative, or some other agent having pharmaceutical or other chemical or physical properties.

Another possible application of the invention is to provide a device for treating a person's teeth or gums using a shower stall or bath installation. Thus, the additive may be an agent for controlling dental plaque or removing toxins in plaque, or for the topical addition of fluoride to teeth, or for application of other pharmaceuticals to the oral cavity. For such purposes, it is desirable to control both the relative proportions of the additive and the diluting water medium and also the total dosage of additive applied in one application cycle. These requirements are satisfied by the present invention.

It is to be noted also that the pump shown in FIGS. 1–3 need not be part of a shower or bath installation, but instead line 16 may be attached directly to any suitable water supply.

As seen in FIG. 1, handpiece 90 may have a perforated hanger member 91 for hanging it on a hook 93 on container 20 when the invention is not in use.

What is claimed is:

1. A device for dispensing a predetermined quantity of a selected additive in liquid form and mixing it with a selected diluting liquid comprising:

a container for holding a supply of said selected additive;

a positive displacement pump comprising a vessel, displacement means within said vessel subdividing the interior of said vessel into a first variable volume additive-containing compartment and a second variable volume diluting liquid-containing compartment, a first port for admitting said additive to said first compartment, a second part for admitting said diluting liquid to said second compartment, first means including an inlet passageway communicating with the interior of said container and a first check valve for conveying additive from said container into said first compartment via said first port, second means including a discharge passageway and a second check valve for conveying additive out of said first compartment via said first port;

means for conveying said diluting liquid from a supply line into said second compartment via said second port; and means for admixing said diluting liquid with said additive as said additive is discharged from said first compartment via said first port, said second check valve, and said discharge passageway.

2. A device according to claim 1 wherein said displacement means comprises a resilient hollow bulb, and further wherein the interior of said hollow bulb constitutes said first compartment and the interior space of said vessel surround said bulb constitutes said second compartment, said bulb also having an opening connected to said first port, whereby said additive may enter said hollow bulb via said first check valve and exit said hollow bulb via said second check valve.

3. A device according to claim 2 wherein said means for conveying said diluting liquid to said second compartment comprises conduit means extending through an opening in said container and adapted to be connected to a supply of said diluting liquid.

4. A device according to claim 3 further including flow means for conveying diluting liquid from said vessel to said discharge passageway, said flow means comprising an orifice of selected size communicating with said discharge passageway and the interior of said vessel.

5. A device according to claim 2 further including an orifice of selected size communicating with said first port for controlling the rate of flow of said additive passing from said first port through said second check valve.

6. A device according to claim 1 wherein said displacement means constitutes a piston disposed for reciprocal movement in said vessel between a first charged position and a second discharged position, and further including a spring within said vessel and engaged with said piston for urging said piston to said first charged position.

7. A device according to claim 6 further including a line shunting said vessel for directing said diluting liquid from said supply line to said discharge passageway so as to cause said diluting liquid to mix automatically with additive flowing out of said first compartment.

8. A device according to claim 7 further including an orifice in said shunt line for controlling the rate of flow or diluting liquid in said shunt line.

9. A device according to claim 1 wherein said displacement means comprises a diaphragm disposed within said vessel and movable in response to the differential in liquid pressures in said first and second compartments.

10. A device according to claim 9 further including a stop means for limiting movement of said diaphragm in response to the pressure of said additive in said first compartment, and a spring for urging said diaphragm toward said stop means.

11. A device according to claim 1 further including a line shunting said vessel for directing said diluting liquid from said supply line to said discharge passageway so as to cause said diluting liquid to mix automatically with said additive flowing out of said first compartment.

12. A device according to claim 1 further including a pressure regulator for controlling the pressure of said diluting liquid in said supply line.

13. A device in accordance with claim 1 in combination with a shower bath system, wherein said diluting liquid is water supplied by said shower bath system.

14. A device according to claim 13 further including a hand-operating fluid-dispensing means, and flexible conduit means connecting said discharge passageway to said hand-operated fluid dispensing means.

15. A device for dispensing a predetermined quantity of a selected additive in liquid form and mixing it with a selected diluting liquid comprising:

a container for holding a supply of said selected additive;

a positive displacement pump comprising a vessel, a resilient hollow bulb within said vessel subdividing the interior of said vessel into a first variable volume additive-containing compartment and a second variable volume diluting liquid-containing compartment, the interior of said hollow bulb constituting said first compartment and the interior space of said vessel surrounding said bulb constituting said second compartment, said bulb also having a tubular extension communicating with its interior space, said vessel having a first port connected to said tubular extension for admitting said additive to said first compartment, a second port for admitting said diluting liquid to said second compartment, first means including an inlet passageway and a first check valve for conveying additive from said container into said first compartment via said first port, second means including a discharge passageway and a second check valve for conveying additive out of said first compartment via said first port;

means for conveying said diluting liquid from a supply line into said second compartment via said second port; and means for admixing said diluting liquid with said additive as said additive is discharged from said first compartment via said first port, said second check valve, and said discharge passageway.

16. A device according to claim 15 wherein said last-mentioned means comprises a passageway leading from said second compartment to said discharge passage.

17. A device according to claim 16 wherein the said passageway leading from said second compartment to said discharge passageway comprises an orifice of selected size for controlling the rate of flow of liquid from said second compartment to said discharge passageway.

18. A device according to claim 15 further including an orifice of selected size communicating with said first port for controlling the rate of flow of said additive passing from said first port through said second check valve.

19. A device according to claim 15 further including a supply line for diluting liquid to said second compartment via said second port, and a pressure regulator for controlling the pressure of said diluting liquid in said supply line.

20. A device in accordance with claim 15 in combination with a shower bath system, said shower bath system comprising a water supply pipe and a shower head connected to the end of said water supply pipe, and further wherein said means for conveying said diluting liquid into said second compartment is a conduit connected to said shower head supply pipe.

21. A device according to claim 20 further including a hand-operating fluid-dispensing means, and means connecting said discharge passageway to said hand-operated fluid dispensing means.

22. In combination with a shower bath system comprising a water supply pipe and a shower head connected to one end of said water supply pipe, a device for dispensing a predetermined quantity of a selected additive in liquid form and mixing it with water delivered by said supply pipe, said device comprising:

a container for holding a supply of said selected additive;

a positive displacement pump comprising a vessel, displacement means within said vessel subdividing the interior of said vessel into a first variable volume additive-containing compartment and a second variable volume-containing compartment, a first port in said vessel for admitting said additive to said first compartment, a second port in said vessel communicating with said second compartment, first means including an inlet passageway communicating with the interior of said container and a first check valve for conveying additive from said container into said first compartment via said first port, second means including a discharge passageway and a second check valve for conveying additive out of said first compartment via said first port, and third means connecting said second port to said supply pipe upstream of said shower head for delivering water to said second compartment from said supply pipe;

means for admixing water supplied by said supply pipe with said additive as said additive is discharged from said first compartment via said first port, said second check valve, and said discharge passageway;

a portable fluid-dispensing nozzle means having an inlet end and a discharge end, and also including a hand-operable on-off valve for controlling the flow of liquid between said inlet and discharge ends; and flexible hose means connecting said discharge passageway to the inlet end of said dispensing means;

whereby when water is flowing through said supply pipe to said shower head and said on-off valve is opened, the water pressure in said second compartment will force said displacement means to reduce the size of said first compartment and thereby expel additive therefrom into said discharge passageway, and when the flow of water to said shower head is terminated, the resulting reduced pressure in said third means will permit said displacement means to increase the size of said first compartment and thereby draw additional additive into said first chamber via said inlet passageway, said first check valve and said first port.

23. A device according to claim 22 wherein said displacement means comprises a resilient hollow bulb, and further wherein the interior of said hollow bulb constitutes said first compartment and the interior space of said vessel surrounding said bulb constitutes said second compartment, said bulb also having an opening connected to said first port, whereby said additive may enter to said hollow bulb via said first check valve and said first port and exit said hollow bulb via said first port and said second check valve.

24. A device according to claim 22 wherein said vessel is disposed within said container.

25. A device for dispensing a predetermined quantity of a selected additive in liquid form and mixing it with a selected diluting liquid comprising:

a container for holding a supply of said selected additive;

a positive displacement pump comprising a vessel, displacement means within said vessel subdividing the interior of said vessel into a first variable volume additive-containing compartment and a second variable volume diluting liquid-containing compartment, a first port for admitting said additive to said first compartment, a second port for admitting said diluting liquid to said second compartment, first means including an inlet passageway communicating with the interior of said container and a first check valve for conveying additive from said container into said first compartment via said first port, second means including a discharge passageway and a second check valve for conveying additive out of said first compartment via said first port;

means for feeding a stream of said diluting liquid from a supply line into said second compartment via said second port; and means for removing said diluting liquid from said second compartment and mixing said removed diluting liquid with said additive as said additive is discharged from said first compartment via said first port, said second check valve, and said discharge passageway.

26. A device according to claim 25 wherein said displacement means comprises a resilient hollow bulb, and further wherein the interior of said hollow bulb constitutes said first compartment and the interior space of said vessel surrounding said bulb constitutes said second compartment, said bulb having an opening communicating with its interior space and a tubular extension surround said opening, and further wherein said tubular extension is connected to said first port, whereby said additive may enter said hollow bulb via said first check valve and said first port and exit said hollow bulb via said first port and second second check valve.

* * * * *

UNITED STATES PATENT AND TRADEMARK OFFICE

CERTIFICATE OF CORRECTION

PATENT NO. : 5,004,158

DATED : April 2, 1991

INVENTOR(S) : Stephen Halem et al

It is certified that error appears in the above-identified patent and that said Letters Patent is hereby corrected as shown below:

Claim 1, column 10, line 3, "part" should be -- port --.

Claim 2, column 10, line 24, "surround" should be -- surrounding --.

Claim 8, column 10, line 60, "or" should be -- of --.

Claim 14, column 11, line 15, "hand-operating" should be -- hand-operated --.

Claim 16, column 11, lines 52 and 53, "passage" should be -- passageway --.

Claim 21, column 12, line 9, "hand-operating" should be -- hand-operated --.

Claim 22, column 12, line 24, "volume-containing" should be -- volume water-containing --.

Claim 23, column 13, line 2, delete the word "to".

UNITED STATES PATENT AND TRADEMARK OFFICE

CERTIFICATE OF CORRECTION

PATENT NO. : 5,004,158

DATED : April 2, 1991

INVENTOR(S) : Stephen Halem et al

It is certified that error appears in the above-identified patent and that said Letters Patent is hereby corrected as shown below:

Claim 26, column 14, line 19, "surround" should be --surrounding--.

Signed and Sealed this

Twenty-eighth Day of July, 1992

*Attest:*

DOUGLAS B. COMER

*Attesting Officer*

*Acting Commissioner of Patents and Trademarks*